US006386991B1

(12) United States Patent
Reyes et al.

(10) Patent No.: US 6,386,991 B1
(45) **Date of Patent: *May 14, 2002**

(54) DUAL DENSITY POLYMER PUTTER

(75) Inventors: Herbert Reyes, Laguna Niguel; Joel B. Erickson, Carlsbad; Wayne H. Byrne, Murrieta, all of CA (US)

(73) Assignee: Callaway Golf Company, Carlsbad, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/663,053

(22) Filed: Sep. 15, 2000

(51) Int. Cl.[7] ..... A63B 53/04; A63B 53/06; A63B 53/08

(52) U.S. Cl. ..... 473/346; 473/340

(58) Field of Search ..... 473/324, 340, 473/345, 349, 334, 335, 336, 337, 338, 339, 329, 332, 347

(56) References Cited

U.S. PATENT DOCUMENTS

| | | | | |
|---|---|---|---|---|
| 3,954,270 A | * | 5/1976 | Cook | 473/252 |
| 4,213,613 A | * | 7/1980 | Nygren | 473/327 |
| 4,326,716 A | * | 4/1982 | LaCoste | 473/349 |
| 4,390,184 A | | 6/1983 | Rudell | |
| 4,591,160 A | * | 5/1986 | Piragino | 273/DIG. 1 |
| 4,793,616 A | | 12/1988 | Fernandez | |
| 4,960,279 A | | 10/1990 | Harris | |
| 5,009,425 A | * | 4/1991 | Okumoto et al. | 473/348 |
| 5,197,737 A | | 3/1993 | Desboilles et al. | |
| 5,333,871 A | * | 8/1994 | Wishon | 273/DIG. 23 |
| 5,570,886 A | | 11/1996 | Rigal et al. | |
| 5,665,014 A | | 9/1997 | Sanford et al. | |
| 5,779,562 A | * | 7/1998 | Melvin et al. | 473/373 |
| 5,797,176 A | | 8/1998 | Rose et al. | |
| 5,842,935 A | * | 12/1998 | Nelson | 473/342 |
| 5,951,412 A | | 9/1999 | Rose et al. | |
| 6,086,484 A | | 7/2000 | Uebelhor | |

FOREIGN PATENT DOCUMENTS

| | | |
|---|---|---|
| WO | WO 99/29374 | 6/1999 |

OTHER PUBLICATIONS

Callister, Jr., William D., Materials Science and Engineering: An Introduction, 4th Edition. New York: John Wiley & Sons, Inc. 1997, pp. 491–494.*

Merriam–Webster's Collegiate Dictionary (www.m–w–.com).*

* cited by examiner

*Primary Examiner*—Paul T. Sewell
*Assistant Examiner*—Alvin A. Hunter
(74) *Attorney, Agent, or Firm*—Michael A. Catania

(57) ABSTRACT

A golf club head (22) composed of an interior body (42) having a first density and an outer shell (40) having a second density is disclosed herein. The golf club head (22) is preferably a putter. A method (100) for forming the golf club head (22) is also disclosed herein. The interior body (42) is preferably composed of an injectable polyurethane material integrated with tungsten to have a density between 4.0 g/cc to 10 g/cc. The outer shell (40) is preferably composed of a thermoplastic material such as an ionomer blend to have a density less than 1.0 g/cc.

18 Claims, 7 Drawing Sheets

DUAL DENSITY POLYMER PUTTER

BACKGROUND OF THE INVENTION

1. Field of the Invention

The present invention relates to putters. More specifically, the present invention relates to polymer-based putters.

2. Description of the Related Art

Conventional methods of manufacturing golf clubs include investment casting, forging and die casting. Inconsistent dimensions and weights are problems with conventional manufacturing techniques. Also, the inability to alter the club weight without changing the size and shape of the club head is another problem with conventional manufacturing techniques. Further, the conventional techniques require polishing to achieve an acceptable finish on the club heads, which results in the removal of mass from the club head. One major problem is the production time to manufacture club heads, which consumes two weeks on average to produce a club head. These problems are associated with manufacturing of putters, irons and woods.

The golf industry needs alternative means of manufacturing golf club heads. One example is set forth in PCT International Publication Number WO 99/29374 to Keelan for a Composite Putter Head, which claims priority to U.S. patent application Ser. No. 08/989,320 filed on Dec. 11, 1997. Keelan discloses that the club head is composed of a plastic material blended with a powder metal that is injection molded to create the club head. Keelan discloses using the following thermoplastic materials: ethylene vinyl acetate, polyurethane, polyolefin, polypropylene, and polyvinylchloride. The metal is added in a range of 50 to 95 percent of the weight of the club head.

Another example is Uebelhor, U.S. Pat. No. 6,086,484, which was filed on Mar. 20, 1998 for a Golf Putter Head. Uebelhor discloses a putter head with a U-shaped body and a block within the middle. The block has a lower specific gravity than the U-shaped body.

Yet another example is Rose et al., U.S. Pat. No. 5,951,412 originally filed in January of 1996 for a Golf Club, Particularly A Putter. The Rose patent discloses a center portion composed of a light metal material and the heel and toe portions composed of heavier metals. The metals are forged or cast to create the putter head.

Another example is Fernandez, U.S. Pat. No. 4,793,616 for a Golf Club, which was originally filed in 1984, discloses a lightweight composite material molded to a hard, high density material for distribution of mass. Fernandez discloses a composite shell with a high density insert composed of tungsten or some other high density material.

BRIEF SUMMARY OF THE INVENTION

The present invention is an unique golf club that is manufactured from a novel process. The golf club of the present invention has an interior body composed of a high density material with an outer shell composed of a lower density thermoplastic injectable material.

The present invention allows for tight tolerances on the dimensions and shapes of golf club heads. It also allows for the weight of the golf club head to be altered quickly and easily during the manufacturing process. The present invention also provides a golf club head that is essentially finished upon demolding. Further, the current process can take as little as two minutes to manufacture a golf club head. Further, the present invention allows for the feel, color and sound of the golf club head to be modified upon a change in the material of the outer shell. Also, the texture of the finished golf club head can be modified by modifying the mold for the outer shell.

One aspect of the present invention is a golf club head that includes an interior body and an outer shell. The interior body is composed of a first injectable material having a first density which is greater than 4.0 g/cc. The outer shell is disposed over the interior body. The outer shell is composed of a second injectable material having a second density which is less than the first density.

Another aspect of the present invention is a method for forming a golf club head. The method includes placing an interior body within a mold with the interior body composed of a first material having a first density that is greater than 4.0 g/cc. The interior body also has a shape substantially similar to the golf club head. The next step is injecting a second material into the mold to encompass the interior body and form an outer shell. The second material has a second density that is less than the first density. The outer shell has a thickness of at least 0.100 inch.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
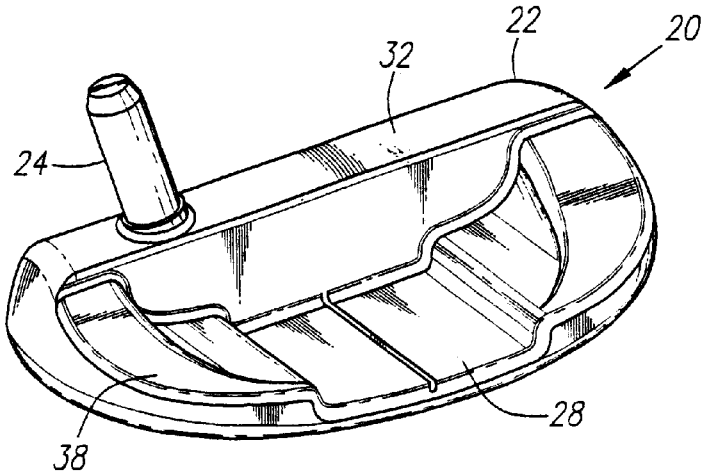
FIG. 1 is a top perspective view of a golf club of the present invention.
Figure 2:
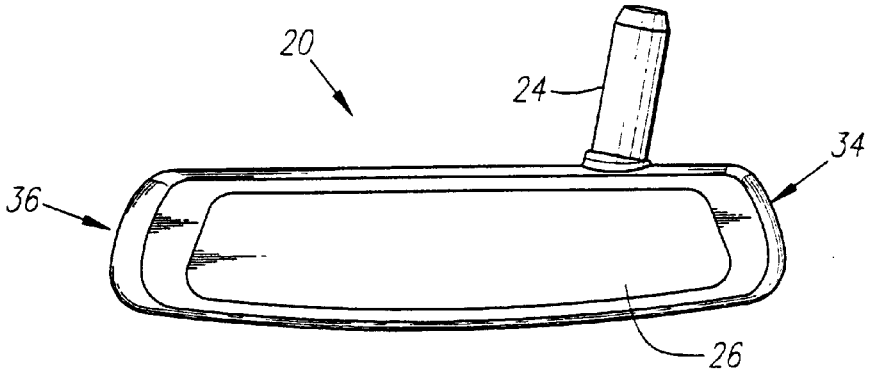
FIG. 2 is a front plan view of FIG. 1.
Figure 3:
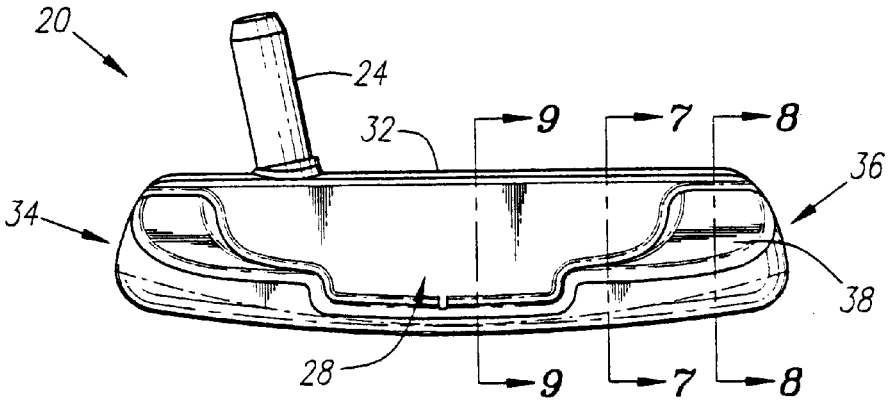
FIG. 3 is a rear plan view of FIG. 1.
Figure 4:
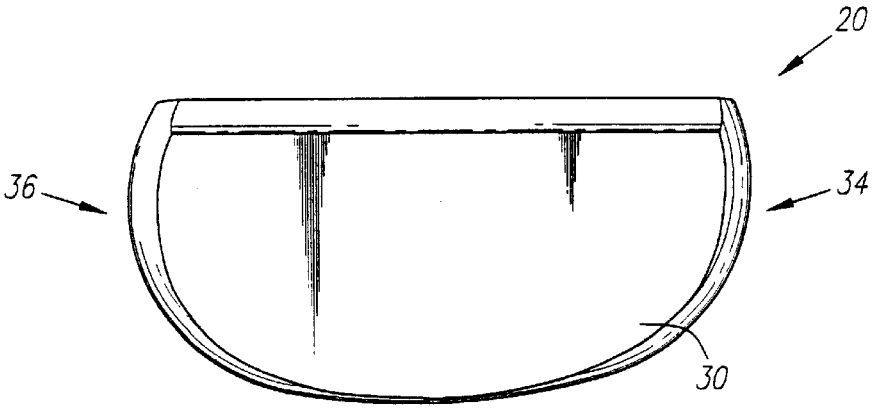
FIG. 4 is a bottom plan view of FIG. 1.
Figure 5:
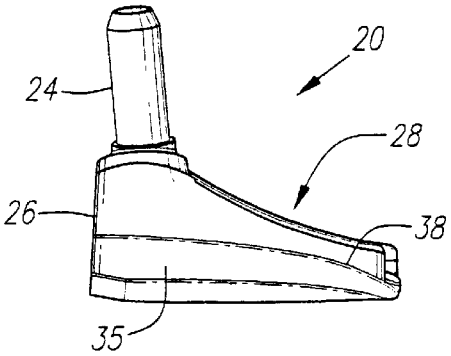
FIG. 5 is a heel side view of FIG. 1.
Figure 6:
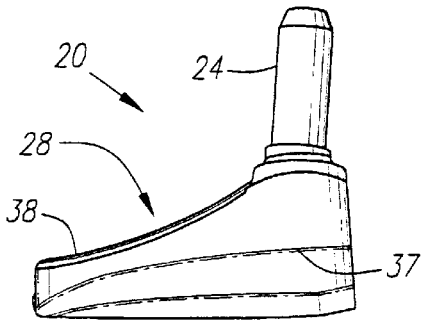
FIG. 6 is a toe side view of FIG. 1.

As shown in FIGS. 1–6, a golf club is generally designated 20. The golf club 20 of FIGS. 1–6 is a putter, however, those skilled in the pertinent art will recognize that the present invention may be used with an iron or a wood. The golf club 20 includes a golf club head 22, a shaft 24 connected to the head through a hosel, a face for striking a golf ball, a rear 28 opposite the face 26, a sole 30, a crown 32 and heel and toe ends 34 and 36. The heel and toe ends 34 and 36 are defined by heel wall 35 and toe wall 37, respectively. In this particular putter 20, the rear 28 has a stepped flange 38 extending rearward opposite the face 26. However, the putter 20 could be a blade style putter without a flange 38. The sole is generally flat with some curvature toward the transition to the face 26, heel wall 35, toe wall 37 and stepped flange 38.

Figure 7:
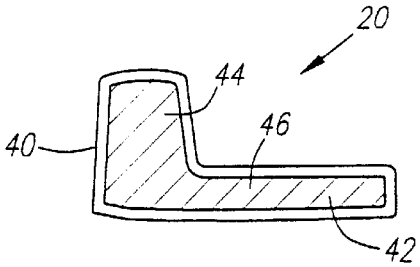
FIG. 7 is a cross-sectional view of the golf club taken along line 7—7 of FIG. 3.
Figure 8:
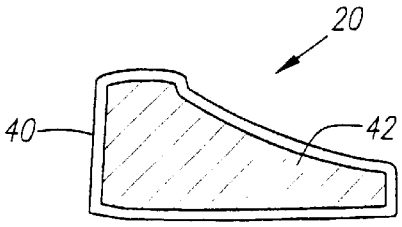
FIG. 8 is a cross-sectional view of the golf club taken along line 8—8 of FIG. 3.
Figure 9:
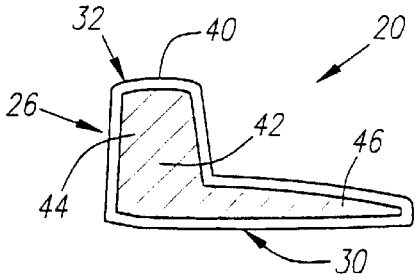
FIG. 9 is a cross-sectional view of the golf club taken along line 9—9 of FIG. 3.

The main aspect of the present invention is illustrated in FIGS. 7–9 which are cross-sectional representations of the golf club head 20. As shown in FIGS. 7–9, the golf club head 22 is composed of an outer shell 40 and an interior body 42. The interior body 42 has a blade portion 44 and a flange portion 46. The interior body 42 is substantially similar to the shape of the golf club head 22, albeit smaller. The interior body 42 is composed of a material that has a higher density than that of the material of the outer shell 40. The interior body 42 provides the mass for control of the center of gravity and moment of inertia of the golf club 20 while the outer shell 40 provides a soft material for better feel and contact with a golf ball.

The outer shell 40 is composed of an injectable material that is injection molded over the interior body 42 as described below. Preferably, the entire surface of the interior body 42 is encompassed by the outer shell 40. The material of the outer shell 40 has a density that is lower than the material of the interior body 42. Preferably, the density of the material of the outer shell 40 is between 0.90 grams/cubic centimeter ("g/cc") to 1.5 g/cc, more preferably 0.92 g/cc to 1.20 g/cc, and most preferably 0.97 g/cc.

The material of the outer shell 40 is a thermoplastic material. Examples of acceptable thermoplastic materials include ionomers, polyether amides, polyisoprene, thermoplastic polyurethanes, block copolymers, and the like. Ionomer materials are available from DuPont Chemical of Wilmington, Del. under the brand SURLYN®, and also from Exxon Chemical of Houston Texas, under the brand IOTEK®. Ionomers are based on ethylene copolymers and containing carboxylic acid groups with metal ions such as sodium, zinc, magnesium, lithium, potassium, cesium, or any polar metal ion that serves as a reversible cross-linking site and results in high levels of resilience and impact resistance. The acid levels in such suitable ionomers may be neutralized to control resiliency, impact resistance and other like properties. In addition, fillers with ionomer carriers may be used to modify (e.g. preferably increase) the specific gravity of the ionomer material. Other exemplary commercially available thermoplastic materials suitable for use in as the material for the outer shell 40 include the following materials and/or blends of the following materials: HYTREL® thermoplastic polyurethane and/or HYLENE® block copolymer products from DuPont, Wilmington, Del.; PEBEX® polyether amide products from Elf Atochem, Philadelphia, Pa.; and ESCOR® thermoplastic polyurethane products from Exxon Chemical, Houston, Tex. Those skilled in the art will recognize that many other thermoplastic materials may be utilized in practicing the present invention without departing from the scope and spirit of the present invention.

The thickness of the outer shell 40 will preferably vary between 0.050 inch to 0.500 inch, more preferably between 0.100 inch to 0.250 inch, and most preferably 0.150 inch. The Shore D hardness, according to ASTM D-2240, of the material of the outer shell 40 preferably will vary between 20 to 70, more preferably between 40 to 60, and most preferably a Shore D of 50. The Rules of Golf, as interpreted by the United States Golf Association, require a minimum hardness of 85 on a Shore A scale, which approximately corresponds to a Shore D of 33.

The interior body 42 is preferably composed of another injectable material, and one that has been "doped" with a heavy metal to increase its density. However, the material of the interior body 42 alternatively may be a cast metal body. The interior body 42 has a density of at least 4.0 g/cc, preferably from 4.5 g/cc to 9.0 g/cc, and most preferably 4.95 g/cc. In a preferred embodiment, the interior body 42 is composed of a thermoplastic polyurethane integrated with tungsten to have a density of 4.95 g/cc. The interior body 42 is formed by injection molding to form a desired shape. Alternatively, the interior body 42 is composed of a nylon material that is integrated with tungsten to have a density of 7.95 g/cc. Yet further, the interior body 42 is formed from a polycarbonate material. Yet further, the interior body 42 is cast from a metal such as tungsten, stainless steel, titanium, titanium alloys, copper, aluminum, beryllium, magnesium, iron, silver, gold, platinum, nickel, or the like.

The interior body 42 is formed to have substantially the same overall shape as that of the finished golf club head 22, albeit smaller. However, the interior body 42 does not have to have the same detailed shape, and may only be a rough approximation of the shape of the final golf club head 22. For example, wherein the golf club head 22 has a finely detailed stepped flange 38 due to the outer shell 40 molding process, the interior body 42 will only have a gradual slope in its flange portion 46 to approximate the stepped flange 38.

Figure 10:
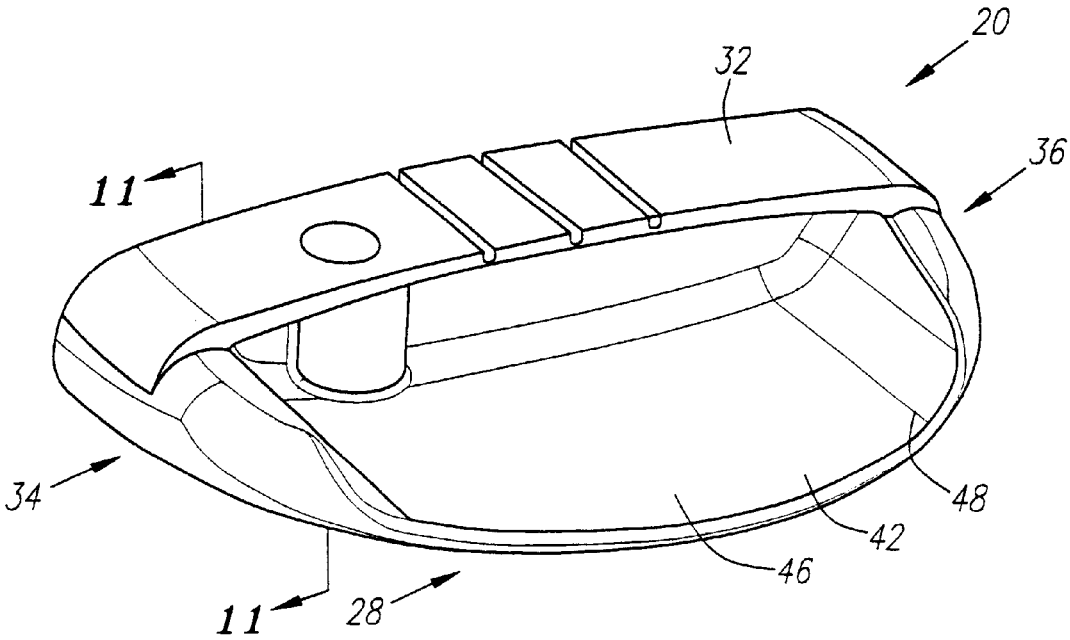
FIG. 10 is a top perspective view of an alternative embodiment of a golf club of the present invention.
Figure 11:
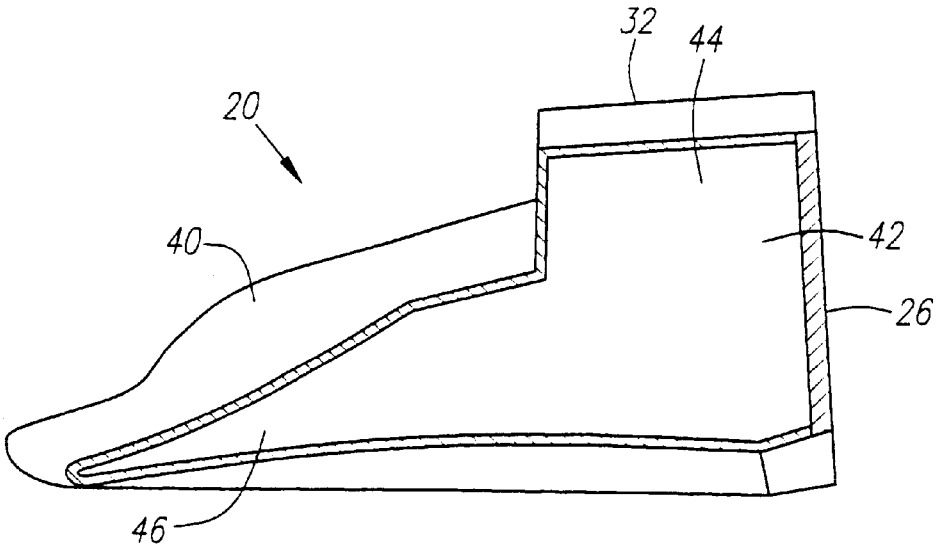
FIG. 11 is a cross-section view of the golf club FIG. 10 taken along line 11—11.

An alternative embodiment of the present invention is shown in FIGS. 10–11. In this embodiment, a portion of the interior body 42 is exposed (without an outer shell 40 covering) as shown in FIG. 11. One surface of the flange portion 46 of the interior body 42 is exposed while the other surfaces of the interior body 42 are covered by the outer shell 40. A transition boundary 48 is covered with an epoxy to prevent separation of the outer shell 40 from the interior body 42.

The weight of the golf club head 22 varies from 300 grams to 450 grams, more preferably from 310 grams to 350 grams, and is most preferably 330 grams. The volume golf club head 22 varies from 35 cubic centimeters ("cc") to 120 cc, more preferably from 40 cc to 70 cc, and is most preferably 60 cc.

Figure 12:
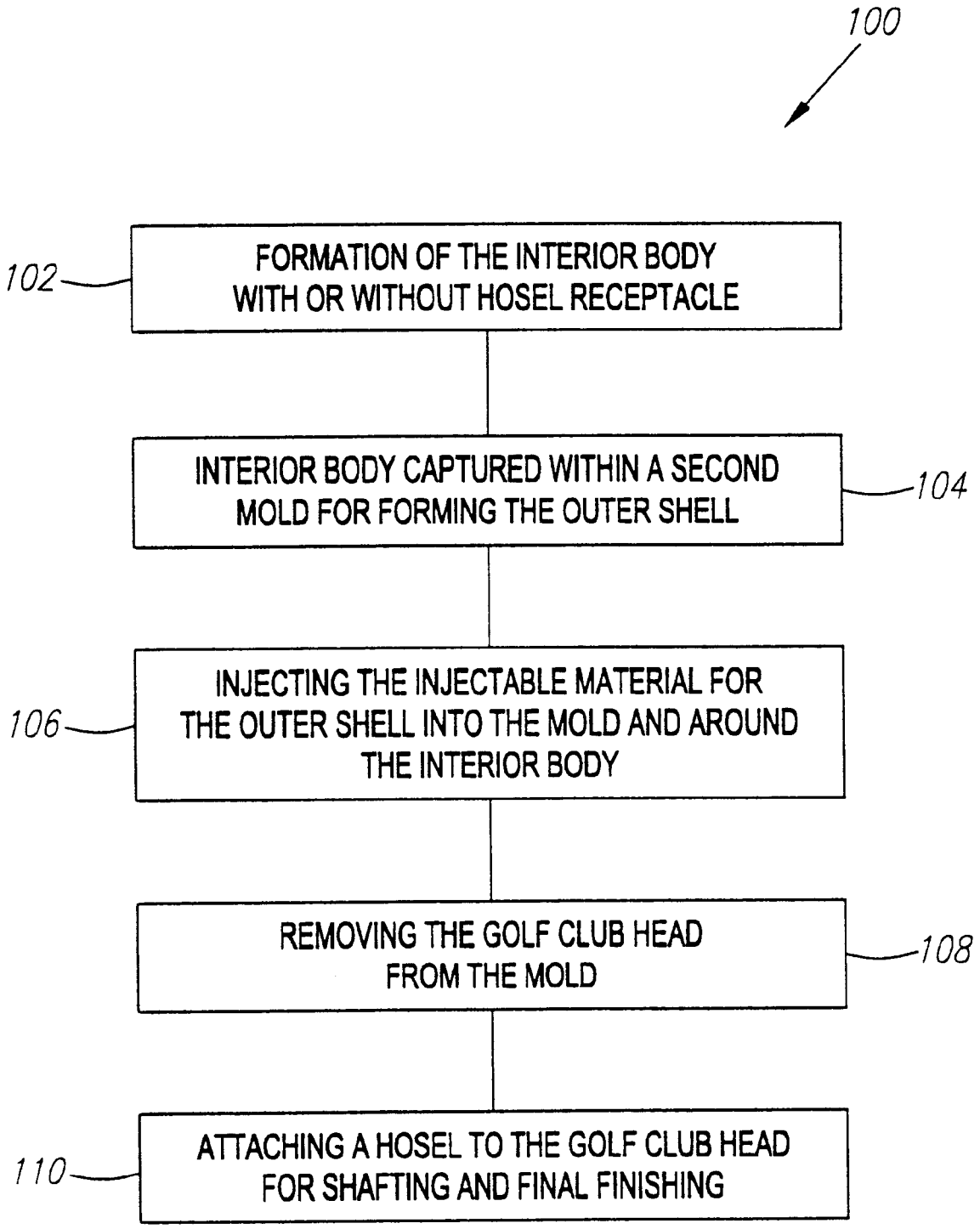
FIG. 12 is a flow chart of the method of the present invention.
Figure 13:
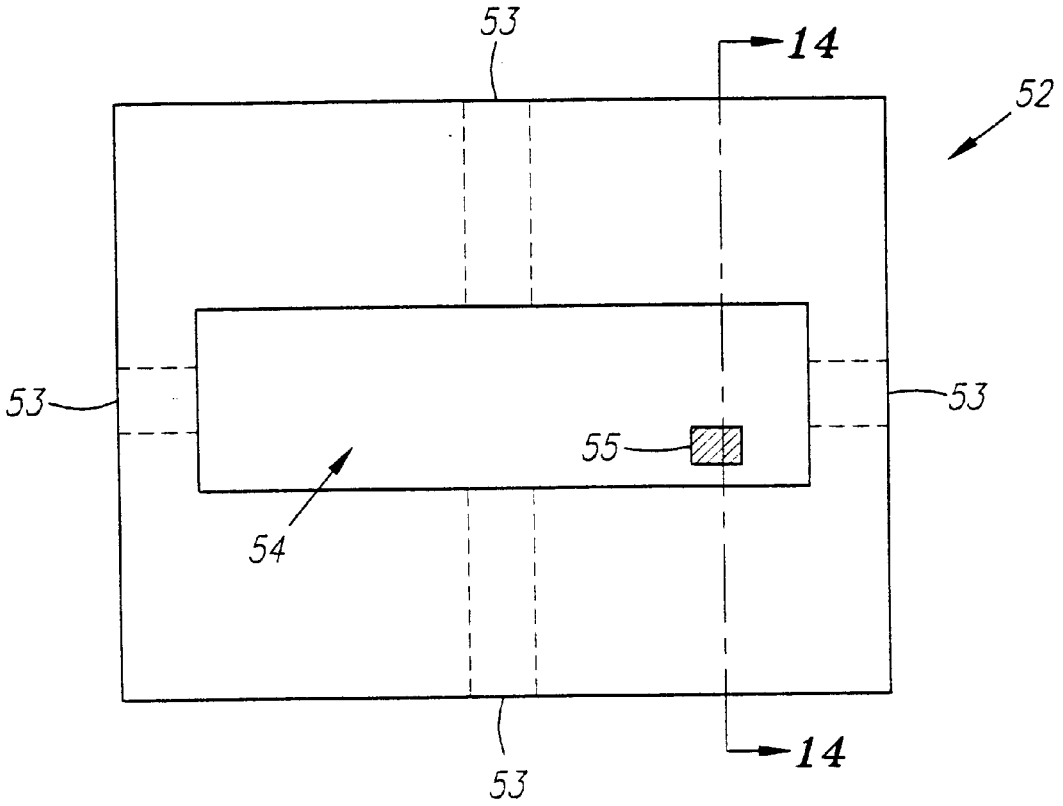
FIG. 13 is a top plan view of a mold half used to form the interior body of the present invention.
Figure 14:
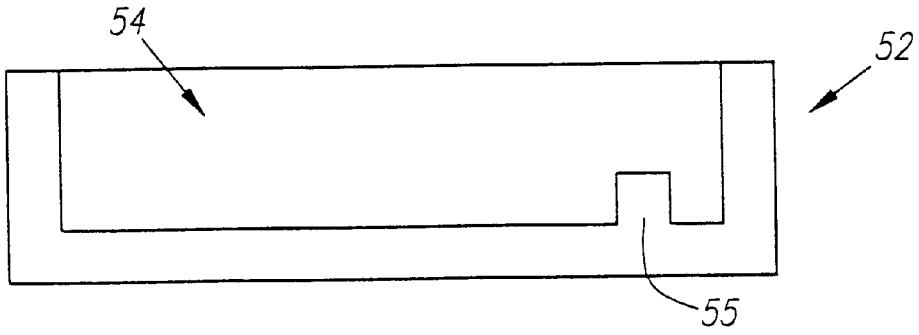
FIG. 14 is a cross-sectional view of the mold half of FIG. 13 along line 14—14.
Figure 15:
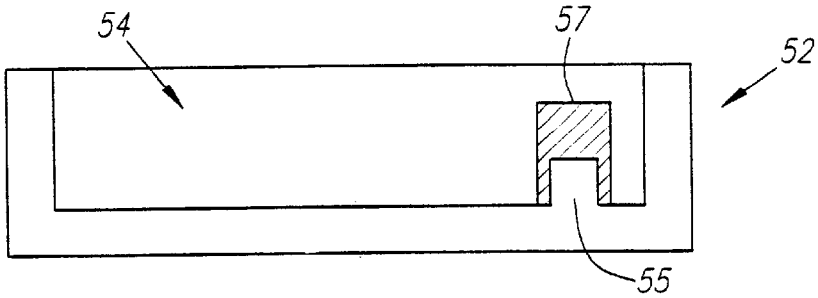
FIG. 15 is a cross-section view of the mold half of FIG. 13 with a hosel receptacle placed therein.

A preferred method for forming the golf club head 22 is set forth in flow chart of FIG. 12. The method 100 begins at block 102 with formation of the interior body 42. Preferably, the formation of the interior body is via injection molding using a first injectable material that has a density of at least 4.0 g/cc. Preferably this material is polyurethane doped with tungsten. Alternatively, the interior body 42 is cast from a metal as described above. As discussed above, the interior body 42 has a shape that is substantially similar to the shape of the final golf club head 22. The use of an injectable material for the interior body 42 increases the production time of manufacturing interior bodies 42 and also allows for the center of gravity, moment of inertia and weight of the golf club head 22 to be modified quickly by substituting a lower density material or a higher density material. The interior body 42 is formed in a mold as shown in FIGS. 13–15. A mold half 52 has a plurality of channels 53 that are in flow communication with a main cavity 54. The main cavity 54 may have a protrusion 55 for placement of a hosel receptacle 57 thereon to be molded with the interior body 42. If a hosel receptacle 57 is not utilized, then the bore for the hosel is created by drilling. The hosel receptacle may be composed of a metal, or a polymer material. A corresponding mold half, not shown, is placed over the mold half 52 and the material is injected into the cavity 54 for formation of the interior body 42. The interior body 42, with or without the hosel receptacle 57 therein, is allowed to cool before application of the outer shell 40.

Figure 16:
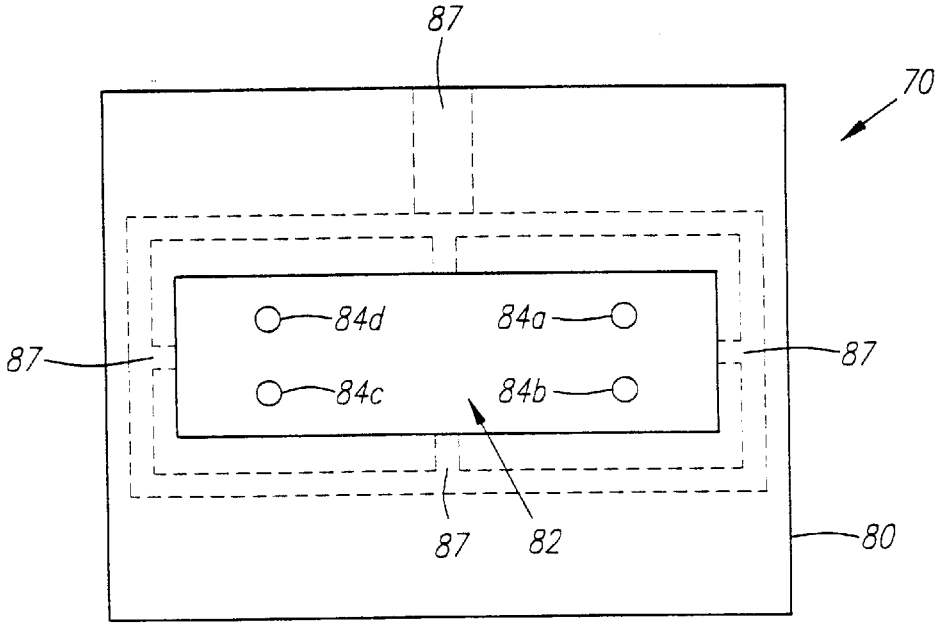
FIG. 16 is a top plan view of a mold half used to manufacture the golf club head of the present invention.
Figure 17:
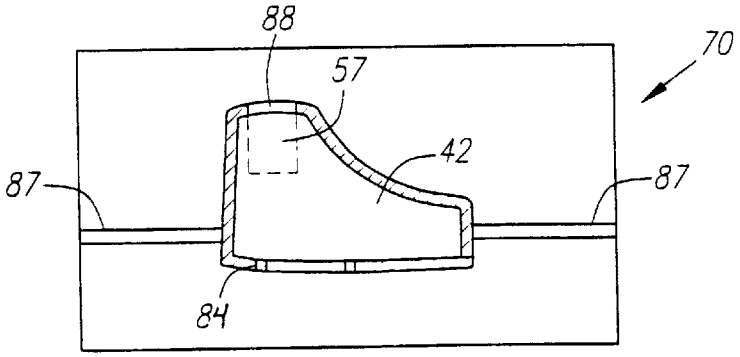
FIG. 17 is a cross-sectional view of a interior body of the present invention within a mold to form the outer shell.

At block 104, the interior body 42 is captured within a mold 70 as shown in FIGS. 16 and 17. The mold 70 is composed of a first mold half 80*a* and a second mold half 80*b* which are mated together during the molding operation. Each mold half 80 has a recess 82 that forms an interior cavity 83 when the mold halves 80*a* and 80*b* are mated together. The interior body 42 is captured on retractable pins 84*a–d* which are retracted during the injection molding process. The injectable material is introduced through gates 87 that are positioned near the parting line 86 of the mold 70. The interior walls 88 of the cavity 83 define the shape of the outer shell 40, the thickness of the outer shell 40, and the shape of the golf club head 22. Additionally, the walls may have an inverse pattern to emboss a design on the outer shell 40, such as a brand name.

Figure 18:
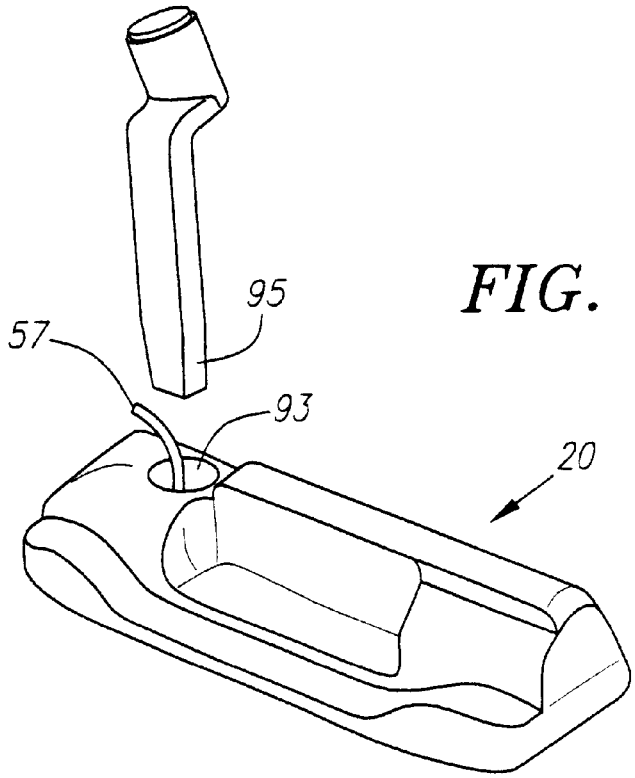
FIG. 18 is an exploded view of a golf club head of the present invention.
Figure 19:
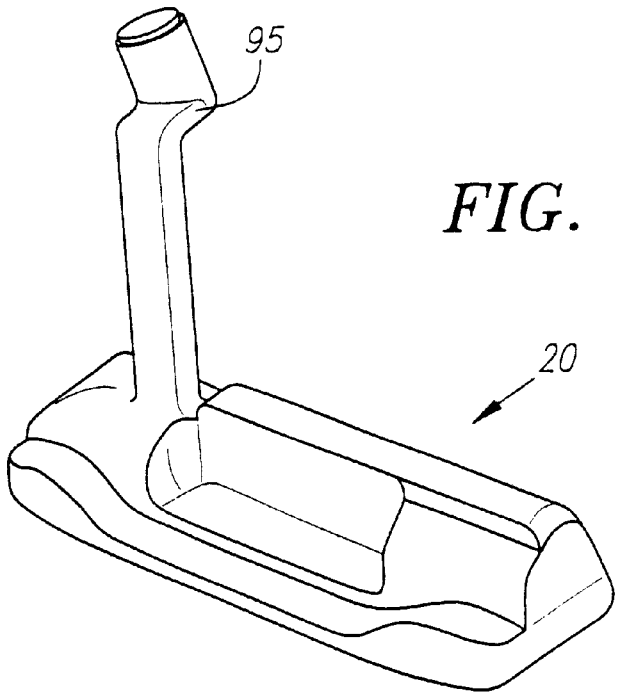
FIG. 19 is a perspective view of the golf club head of the present invention.

At block 106, the injectable material for the outer shell 40 is injected into the cavity 83 via the gates 87. The injectable material is a thermoplastic material as described above. At block 108, the golf club head 22, with the outer shell 40 covering the interior body 42, is removed from the mold 70. At block 110, a hosel 95 is connected to the golf club head 22 as shown in FIGS. 18 and 19. The hosel 95 is placed within an aperture 93 of the hosel receptacle 57. The use of the hosel receptacle 57 allows for the loft and lie angles of the golf club 20 to be fixed during the molding process.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a solid inner body having a blade portion and a flange portion composed of a first injectable material having a first density, the first density greater than 4.0 g/cc; and an outer shell disposed over the solid inner body, the outer shell composed of a second injectable material having a second density, the second density less than the first density; and the outer shell having a Shore D hardness of between 40 to 60;

wherein the weight of the club head is from 300 grams to 350 grams.

2. The golf club head according to claim 1 wherein the first injectable material is a polyurethane material integrated with tungsten.

3. The golf club head according to claim 2 wherein the tungsten is between 5 to 20 percent of the volume of the body.

4. The golf club head according to claim 1 wherein the second injectable material is a material selected from the group consisting of ionomer, polyether block amide, thermoplastic polyurethane or block copolymer.

5. The golf club head according to claim 1 wherein the outer shell has a thickness of between 0.100 inch and 0.500 inch.

6. The golf club head according to claim 1 wherein the volume of the body is from 40 cc to 70 cc.

7. The golf club head according to claim 1 wherein the first injectable material is composed of a nylon material integrated with tungsten.

8. The golf club head according to claim 7 wherein the first injectable material has a first density between 6.5 g/cc and 10 g/cc.

9. A putter head comprising:

a solid interior body composed of a polyurethane material integrated with a high density metal, the interior body having a density of 4.0 g/cc to 10 g/cc and occupying a volume of at least 100 cc;

an outer shell encompassing the interior body, the outer shell composed of a polymer material having a density less than 1.0 g/cc, the outer shell having a thickness of between 0.100 inch to 0.500 inch; and a Shore D hardness of between 40 to 60;

wherein the weight of the club head is from 300 grams to 350 grams.

10. The golf club head according to claim 1 wherein the second injectable material is a material selected from the group consisting of ionomer, polyether block amide, thermoplastic polyurethane or block copolymer.

11. A method for forming a golf club head, the method comprising:

injecting a first injectable material having a first density that is greater than 4.0 g/cc into a mold having a first mold half and a second mold half mated together to form an interior body;

the interior body having a blade portion and a flange portion and having a shape substantially similar to the golf club head;

capturing the interior body within a second mold;

wherein the second mold has a first mold half and a second mold half and a plurality of gates located along the parting line of the first mold half and the second mold half;

wherein each mold half has a recess to an interior cavity and a plurality of retractable pins which captures the interior body;

injecting a second material into the second mold cavity via the plurality of gates to encompass the solid interior body and form an outer shell, the second material having a second density that is less than the first density, and the outer shell having a thickness of between 0.100 inch to 0.250 inch, a Shore D hardness of between 40 to 60;

and wherein the weight of the club head is between 300 grams to 350 grams.

12. The method according to claim 11 where in the first material is polyurethane material integrated with tungsten.

13. The method according to claim 12 wherein the tungsten is between 5 to 20 percent of the volume of the body.

14. The method according to claim 11 wherein the second material is a material selected from the group consisting of ionomer, polyether block amide, thermoplastic polyurethane and block copolymer.

15. The method according to claim 11 wherein the outer shell has a thickness of between 0.100 inch and 0.500 inch.

16. The method according to claim 11 wherein the volume of the interior body is from 40 cc to 70 cc; and wherein the total volume of the club head is between 35 cc to 120 cc.

17. The method according to claim 11 wherein the first material is composed of a nylon material integrated with tungsten.

18. The method according to claim 11 wherein the first material has a first density between 6.5 g/cc and 10 g/cc.

* * * * *